US012447393B2

(12) United States Patent
Qiao

(10) Patent No.: US 12,447,393 B2
(45) Date of Patent: Oct. 21, 2025

(54) POOL TABLE CAPABLE OF AVOIDING BALL BOUNCE

(71) Applicant: Yuanxu Qiao, Qinhuangdao (CN)

(72) Inventor: Yuanxu Qiao, Qinhuangdao (CN)

( * ) Notice: Subject to any disclaimer, the term of this patent is extended or adjusted under 35 U.S.C. 154(b) by 0 days.

(21) Appl. No.: 18/736,415

(22) Filed: Jun. 6, 2024

(65) Prior Publication Data

US 2024/0342584 A1 Oct. 17, 2024

Related U.S. Application Data

(63) Continuation of application No. PCT/CN2022/131875, filed on Nov. 15, 2022.

(30) Foreign Application Priority Data

Dec. 16, 2021 (CN) ..... 202111542227.5

(51) Int. Cl.
*A63D 15/06* (2006.01)

(52) U.S. Cl.
CPC ..... *A63D 15/06* (2013.01)

(58) Field of Classification Search
CPC ..... A63D 15/06
USPC ..... 473/31, 32
See application file for complete search history.

(56) References Cited

U.S. PATENT DOCUMENTS 22,001 A * 11/1858 Winant ..... A63D 15/00 473/29
114,410 A * 5/1871 Collender ..... A63D 15/06 473/32
RE5,349 E * 4/1873 Sharp ..... 473/32
569,519 A * 10/1896 Rodd ..... A63D 15/06 473/32
986,543 A * 3/1911 Burroughes ..... A63D 15/06 473/32
1,115,761 A * 11/1914 Adler ..... A63D 15/06 473/32
1,118,461 A * 11/1914 Adler ..... A63D 15/06 473/32

(Continued)

FOREIGN PATENT DOCUMENTS

CN 1126445 A 7/1996
CN 2451183 Y 10/2001

(Continued)

OTHER PUBLICATIONS

Internation Search Report of PCT/CN2022/131875, Mailed Feb. 7, 2023.

*Primary Examiner* — Mitra Aryanpour

(57) ABSTRACT

A pool table capable of avoiding ball bounce, including a playing field and a rail structure mounted along an edge thereof. The rail structure includes a steel rail and a rubber strip mounted at an inner side thereof. A ratio of height difference H between top surfaces of the rubber strip and the playing field to diameter D of a billiard ball is 0.68-0.74. A position of the rubber strip in contact with the billiard ball is configured as a striking point. A coordinate system is established with a center of the billiard ball as origin, a horizontal line passing through the origin as abscissa axis, and a vertical line passing through the origin as ordinate axis. The striking point is higher than the center of the billiard ball. An angle between a line connecting the origin to the striking point and the abscissa axis is 2°-8°.

19 Claims, 2 Drawing Sheets

(56) References Cited

U.S. PATENT DOCUMENTS

| | | | | | |
|---|---|---|---|---|---|
| 1,119,212 | A * | 12/1914 | Abbott | A63D 15/06 | 473/32 |
| 1,556,289 | A * | 10/1925 | Ling | A63D 15/06 | 473/32 |
| 1,613,403 | A * | 1/1927 | Miller | A63D 15/06 | 473/32 |
| 5,482,268 | A | 1/1996 | Driska | | |
| 7,211,003 | B2 * | 5/2007 | Halstead | A63D 15/04 | 473/29 |
| 2024/0342584 | A1 * | 10/2024 | Qiao | A63D 15/003 | 473/31 |

FOREIGN PATENT DOCUMENTS

| | | |
|---|---|---|
| CN | 217092027 U | 8/2022 |
| GB | 201009754 | 7/2010 |
| TW | 415253 U | 12/2000 |

* cited by examiner

POOL TABLE CAPABLE OF AVOIDING BALL BOUNCE

CROSS-REFERENCE TO RELATED APPLICATIONS

This application is a continuation of International Patent Application No. PCT/CN2022/131875, filed on Nov. 15, 2022, which claims the benefit of priority from Chinese Patent Application No. 202111542227.5, filed on Dec. 16, 2021. The content of the aforementioned application, including any intervening amendments made thereto, is incorporated herein by reference in its entirety.

TECHNICAL FIELD

This application relates to sports equipment, and more particularly to a pool table capable of avoiding ball bounce.

BACKGROUND

The pool table consists of a playing field, a table edge (also called rails) and multiple legs. The legs are configured to support a bottom of the playing field, and the rails are fixedly arranged around the playing field to form a region for the billiard balls to roll after being hit. For the existing pool tables, a phenomenon of ball bounce (that is, the cue ball or the target ball will bounce in an oblique upward direction to varying degrees after striking the rubber strip of the rail) may occur when the billiard ball strikes the rail structure. Even a slight ball bounce will affect the rolling trajectory of the cue ball or the target ball, thus affecting the performance of a player or playability. In the case of a serious ball bounce, the ball can bounce over the rail and fall to the ground, causing the player to miss the opportunity. The ball bounce is by far a commonly-occurring problem in billiards games.

Therefore, in order to improve the entertainment and playability of billiards games, it is urgent to solve the problem of ball bounce.

SUMMARY

In view of the above deficiencies in the prior art, the present disclosure provides a pool table capable of avoiding ball bounce, which can solve the problem of ball bounce in the existing pool tables, thereby improving the game effect and entertainment of billiards games.

Technical solutions of the present disclosure are described as follows.

This application provides a pool table capable of avoiding ball bounce, comprising:

a playing field; and a rail structure mounted along an edge of the playing field;

wherein the rail structure comprises a steel rail and a rubber strip mounted at an inner side of the steel rail; and a ratio of a height difference H between a top surface of the rubber strip and a top surface of the playing field to a diameter D of a billiard ball is 0.68-0.74; and a position of the rubber strip configured to be in contact with the billiard ball is configured as a striking point; a center of the billiard ball is configured as an origin of a coordinate system; a horizontal line passing through the origin is configured as an abscissa axis of the coordinate system, and a vertical line passing through the origin is configured as an ordinate axis; the striking point is higher than the center of the billiard ball; and an angle between a line connecting the origin to the striking point and the abscissa axis is 2 degrees to 8 degrees.

In some embodiments, a cross section of the steel rail is in a rectangular shape, a trapezoidal shape, an S shape, a "]" shape, an L shape, a T shape, an I shape, a "]" shape or a "[" shape.

In some embodiments, a surface of a side of the steel rail facing toward the rubber strip is provided with a first groove extending along a length direction of the steel rail; the rubber strip is provided with a protrusion fitting the first groove in shape; and the protrusion is embedded in the first groove.

In some embodiments, the first groove is a dovetail groove, a rectangular groove, a T-shaped groove or a trapezoidal groove.

In some embodiments, a cross section of the rubber strip is in a rectangular shape or a "]" shape.

In some embodiments, a surface of the steel rail abutting a side of the playing field is provided with a second groove.

In some embodiments, the second groove is a rectangular groove.

In some embodiments, the steel rail comprises a horizontal extension portion and a vertical extension portion; and a width of the horizontal extension portion is equal to that of the vertical extension portion.

In some embodiments, the width of the horizontal extension portion is 20 mm (0.787 inches).

In some embodiments, the ratio of the height difference H to the diameter D of the billiard ball is 0.70; and the angle between the line connecting the origin to the striking point and the abscissa axis is 5 degrees.

Compared with the prior art, this disclosure has the following advantages.

(1) For the pool table in this application, a ratio of a height of the rail to the diameter of the billiard ball is optimized to prevent ball bounce. The height difference H is set to be 0.68-0.74 times the diameter D of the billiard ball. When the height difference H is less than 0.68 times the diameter D of the billiard ball, the ball bounce will occur. When the height difference H greater than 0.74 times the diameter D of the billiard ball, an elasticity of the rail will decrease significantly, thus affecting a rebound effect of the billiard ball after striking the rubber strip. Moreover, a height of a top of the billiard ball exposed to an edge of the rail is reduced, which causes the player to easily slip and miss the ball when hitting the ball, thereby affecting the performance of the player and the entertainment of billiards games.

(2) The pool table of the present disclosure not only provides the optimization of a height of the rubber strip, but also provides an innovative design of a position of the striking point. The center of the billiard ball is configured as the origin, the horizontal line passing through the origin is configured as the abscissa axis, and the vertical line passing through the origin is configured as the ordinate axis. The angle of 2 degrees to 8 degrees is formed between the line connecting the center of the billiard ball to the striking point and the abscissa axis. Based on a precise design of a range of the angle, a striking force generated by the billiard ball when it strikes the rubber strip forms an oblique downward component force, thereby avoiding the phenomenon of ball bounce when the billiard ball strikes the rubber strip.

(3) The pool table of the present disclosure adopts the steel rail in the rail structure and the rubber strip fixedly mounted at the inner side of the steel rail. The steel rail is mounted around the playing field, such that a stiffness and a and strength of the steel rail are greatly improved compared to existing wooden rails, Moreover, when the billiard ball strikes the steel rail, the steel rail has a small deformation, leading to a small mechanical energy loss of the billiard ball. This allows a collision between the billiard ball and the rail closer to an elastic collision, thereby significantly improving a rebound force of the rail against the billiard ball and improving the game experience and interest of the player.

(4) Due to the arrangement of the first groove provided at the surface of the side of the steel rail where the rubber strip is mounted and the protrusion fitting the first groove in shape, the rubber strip is fitted with the steel rail in a concave-convex manner, such that a rapid positioning and mounting of the rubber strip and the steel rail can be realized, thereby shortening the assembly time and improving the assembly efficiency of the rail structure. Meanwhile, the concave-convex fitting between the first groove and the protrusion also facilitates the restriction of the rubber strip in a vertical direction, which can prevent the rubber strip from being dislocated due to weak mounting, and reduce a downward deformation of the rubber strip, further reducing a probability of ball bounce.

(5) In order to ensure the mounting accuracy of the pool table, a joint surface of the steel rail in contact with the playing field requires a high surface accuracy. Since the second groove is provided on the surface of the side of the steel rail abutting the side of the playing field, a processing surface area of the steel rail can be greatly reduced through the second groove. Moreover, an inner side of the second groove does not require high machining accuracy. Therefore, the arrangement of the second groove on the surface of the steel rail can reduce a processing area of the steel rail, which can improve the processing efficiency of the steel rail and contribute to improving the flatness of said side surface, thereby improving the assembly accuracy and assembly quality of the pool table.

Figure 1:
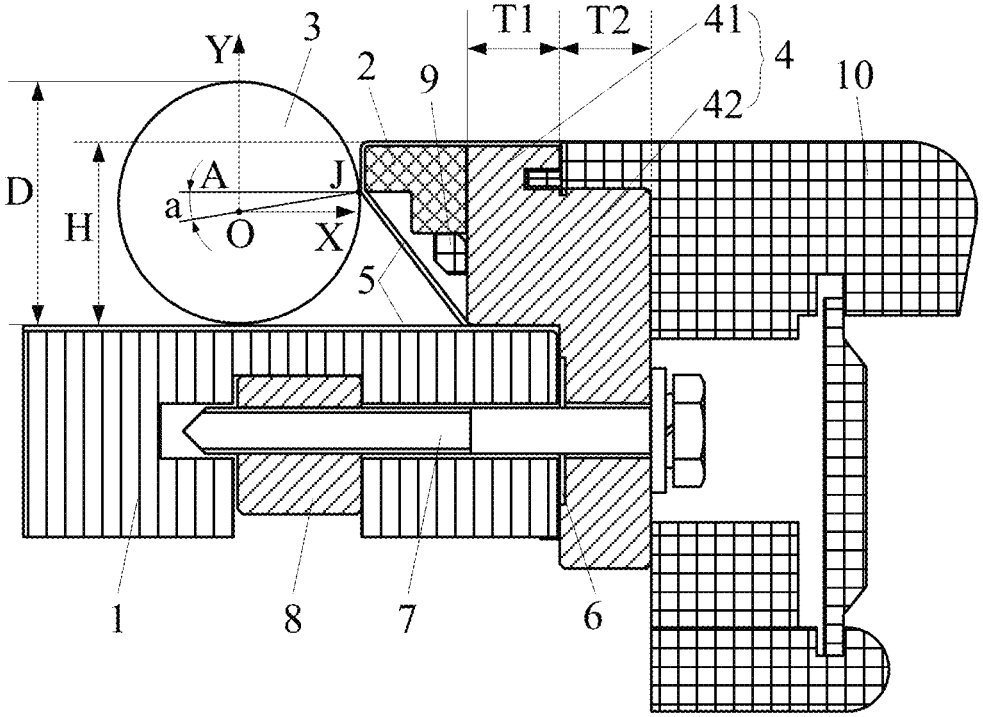
FIG. 1 schematically shows a first assembly of a rail structure and a playing field of a pool table in accordance with an embodiment of the present disclosure.

In the drawings: 1—slate; 2—rubber strip; 3—billiard ball; 4—steel rail; 5—tablecloth; 6—groove; 7—bolt; 8—nut; 9—support bar; 10—handrail; 11—pressing strip; and 12—protrusion.

DETAILED DESCRIPTION OF EMBODIMENTS

The present disclosure will be described in detail below with reference to the accompanying drawings and embodiments.

Embodiment 1

A pool table capable of avoiding ball bounce is provided, including a playing field and a rail structure mounted along an edge of the playing field. FIG. 1 is a cross-sectional view of an assembly of the playing field and the rail structure. The playing field is arranged horizontally and supported by multiple legs (not shown in the drawings).

The playing field can be composed of a spliced slate 1 and a tablecloth 5 wrapping the slate 1.

The rail structure includes a steel rail 4 and a rubber strip 2 mounted at an inner side of the steel rail 4. As shown in FIG. 1, the steel rail 4 is mounted on an outer peripheral side of the slate 1, and is configured for stopping a billiard ball 3. The rubber strip 2 is mounted at a top inner side of the steel rail 4. A handrail 10 is mounted at an outer side of the steel rail 4. In order to make the pool table in an elegant appearance, the rubber strip 2 and an outer side of the playing field are wrapped with the table cloth 5. The billiard ball 3 will strike the rubber strip 2 when it moves to the rail, leading to a rebound force. In order to prevent the billiard ball 3 from falling when it reaches the rail, there is a height difference H between a top surface of the rubber strip 2 and a top surface of the playing field. A ratio of the height difference H to a diameter D of the billiard ball 3 is 0.68-0.74, such as 0.68, 0.69, 0.70, 0.71, 0.72, 0.73 and 0.74.

When the billiard ball 3 rolls along the playing field after being hit by a player, the billiard ball 3 is in contact with the rubber strip 2 to form a striking point J. A center of the billiard ball 3 is configured as an origin O of a coordinate system. A horizontal line passing through the origin O is configured as an abscissa axis X of the coordinate system, and a vertical line passing through the origin O is configured as an ordinate axis Y. The striking point J is higher than the center of billiard ball 3. An angle $\alpha$ of 2 degrees to 8 degrees is formed between a line OJ connecting the origin O to the striking point J and the abscissa axis X, and can be 2 degrees, 3 degrees, 4 degrees, 5 degrees, 6 degrees, 7 degrees or 8 degrees.

For the above pool table, a ratio of a height of the rail to the diameter D of the billiard ball is optimized to prevent ball bounce. The height difference H is set to be 0.68-0.74 times the diameter D of the billiard ball 3. When the height difference H is less than 0.68 times the diameter D of the billiard ball 3, the ball bounce will occur. When the height difference H greater than 0.74 times the diameter D of the billiard ball 3, an elasticity of the rail will decrease significantly, thus affecting the rebound effect of the billiard ball 3 after striking the rubber strip 2. Moreover, a height of a top of the billiard ball exposed to an edge of the rail is reduced, which causes the player to easily slip and miss the ball when hitting the ball, making the player unable to accurately control a force applied to the billiard ball 3 and a movement trajectory of the billiard ball 3 after striking, thereby affecting the performance of the player and the entertainment of billiards games.

In order to further improve the capacity of avoiding ball bounce of the pool table, while optimizing a height of the rubber strip 2, a position of the striking point J is innovatively designed, that is, based on the existing billiard ball 3, when the billiard ball 3 comes into contact with the rubber strip 2, the angle between the line OJ and the abscissa axis X is set to be 2 degrees to 8 degrees. Based on the precise design of a range of the angle $\alpha$, a striking force generated by the billiard ball 3 when it strikes the rubber strip 2 forms an oblique downward component force to prevent the billiard ball 3 from bouncing upward, thereby avoiding the phenomenon of ball bounce when the billiard ball 3 strikes the rubber strip 2.

The ratio of the height difference H to the diameter D of the billiard ball 3 and the angle $\alpha$ are applicable to various models and series of pool tables. After the diameter D of the billiard ball 3 used in conjunction with the pool table is determined, a height range of the rail can be determined while ensuring no ball bounce. Otherwise, in a case where the height of the rail is determined, a billiard ball 3 enabling to prevent the occurrence of the ball bounce can be selected according to the height of the rail, thereby ensuring an excellent gaming experience and entertainment of billiards games through the ratio of the height difference H to the diameter D of the billiard ball 3, and providing a solid foundation for the further popularization and promotion of the billiards.

Figure 3:
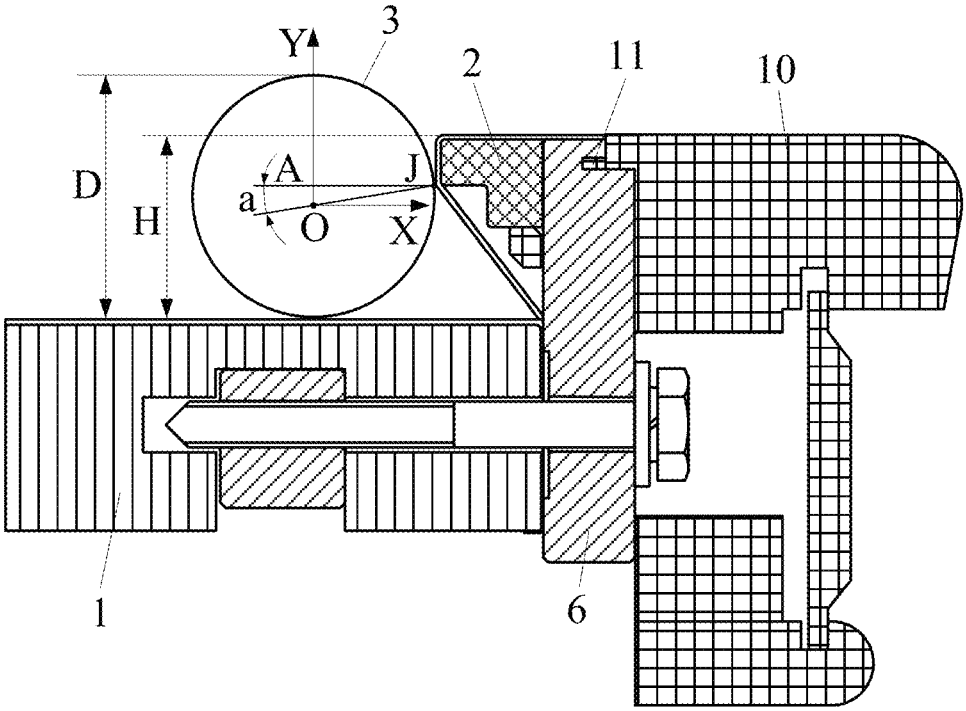
FIG. 3 schematically shows a third assembly of the rail structure and the playing field in accordance with an embodiment of the present disclosure.

In an embodiment, a cross section of the steel rail 4 is in, but not limited to, a rectangular shape, a trapezoidal shape, an S shape, a "]" shape, an L shape, a T shape, an I shape, a "]" shape or a "[" shape. In this embodiment, the steel rail 4 is in the "]" shape, as shown in FIG. 1. However, the cross section of the steel rail 4 is not limited to the "]" shape in FIG. 1, which can also be the rectangular shape in FIG. 3. The steel rail 4 can adopt various shapes of cross sections described above, which can enrich an appearance of the pool table to avoid the same style of the pool table and attract consumers through various shapes, thereby increasing the sales of pool tables, and thus increasing the revenue of pool table manufacturing enterprises.

Embodiment 2

A pool table capable of avoiding ball bounce is provided, including a playing field and a rail structure mounted along an edge of the playing field. FIG. 1 is a cross-sectional view of an assembly of the playing field and the rail structure. The playing field is arranged horizontally and supported by multiple legs (not shown in the drawings).

The playing field can be composed of a spliced slate 1 and a tablecloth 5 wrapping the slate 1.

Figure 2:
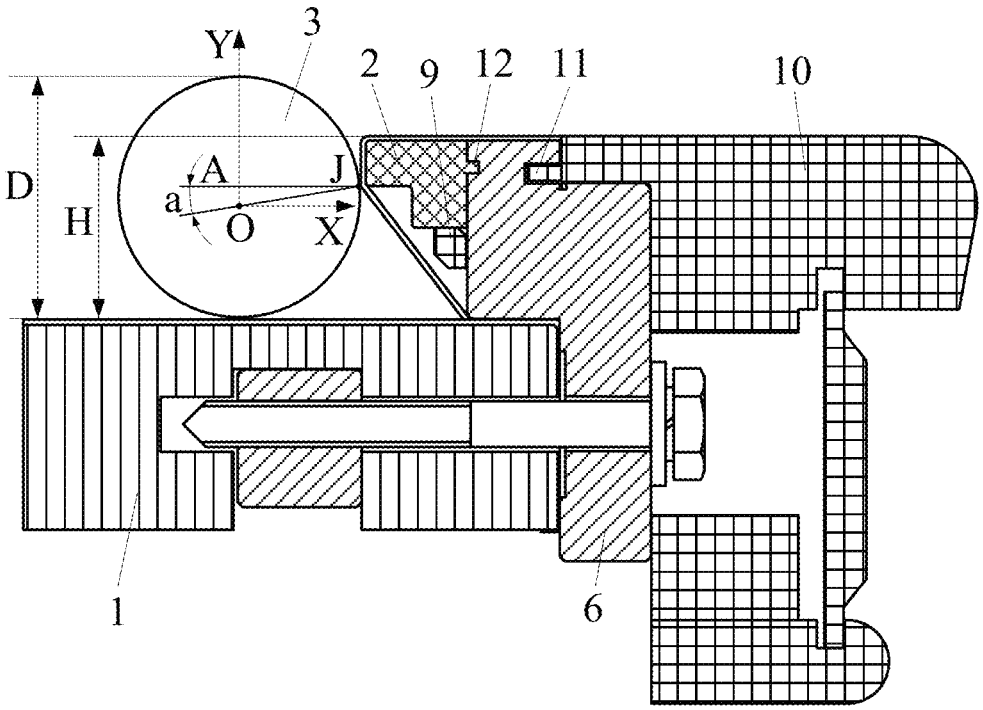
FIG. 2 schematically shows a second assembly of the rail structure and the playing field in accordance with an embodiment of the present disclosure.

The rail structure includes a steel rail 4 and a rubber strip 2 mounted at an inner side of the steel rail 4. As shown in FIG. 2, the steel rail 4 is mounted on an outer peripheral side of the slate 1, and is configured for stopping a billiard ball 3. A cross section of the steel rail 4 is in, but not limited to, a rectangular shape, a trapezoidal shape, an S shape, a "]" shape, an L shape, a T shape, an I shape, a "]" shape or a "[" shape. In this embodiment, the steel rail 4 is in the "]" shape, as shown in FIG. 2. However, the cross section of the steel rail 4 is not limited to the "]" shape in FIG. 2, which can also be the rectangular shape in FIG. 3.

The rubber strip 2 is mounted at a top inner side of the steel rail 4. A handrail 10 is mounted at an outer side of the steel rail 4. In order to make the pool table in an elegant appearance, the rubber strip 2 and an outer side of the playing field are wrapped with the table cloth 5. The billiard ball 3 will strike the rubber strip 2 when it moves to the rail, leading to a rebound force. In order to prevent the billiard ball 3 from falling when it reaches the rail, there is a height difference H between a top surface of the rubber strip 2 and a top surface of the playing field. A ratio of the height difference H to a diameter D of the billiard ball 3 is 0.68-0.74, such as 0.68, 0.69, 0.70, 0.71, 0.72, 0.73 and 0.74.

When the billiard ball 3 rolls along the playing field after being hit by a player, the billiard ball 3 is in contact with the rubber strip 2 to form a striking point J. A center of the billiard ball 3 is configured as an origin O of a coordinate system. A horizontal line passing through the origin O is configured as an abscissa axis X of the coordinate system, and a vertical line passing through the origin O is configured as an ordinate axis Y. The striking point J is higher than the center of billiard ball 3. An angle $\alpha$ of 2 degrees to 8 degrees is formed between a line OJ connecting the origin O to the striking point J and the abscissa axis X, and can be 2 degrees, 3 degrees, 4 degrees, 5 degrees, 6 degrees, 7 degrees or 8 degrees.

For the above pool table, a ratio of a height of the rail to the diameter D of the billiard ball is optimized to prevent ball bounce. The height difference H is set to be 0.68-0.74 times the diameter D of the billiard ball 3. When the height difference H is less than 0.68 times the diameter D of the billiard ball 3, the ball bounce will occur. When the height difference H greater than 0.74 times the diameter D of the billiard ball 3, an elasticity of the rail will decrease significantly, thus affecting the rebound effect of the billiard ball 3 after striking the rubber strip 2, making the player unable to accurately control a force applied to the billiard ball 3 and a movement trajectory of the billiard ball 3 after striking, thereby affecting the performance of the player and the entertainment of billiards games.

In order to further improve the capacity of avoiding ball bounce of the pool table, while optimizing a height of the rubber strip 2, a position of the striking point J is innovatively designed, that is, based on the existing billiard ball 3, when the billiard ball 3 comes into contact with the rubber strip 2, the angle between the line OJ and the abscissa axis X is set to be 2 degrees to 8 degrees. Based on the precise design of a range of the angle $\alpha$, a striking force generated by the billiard ball 3 when it strikes the rubber strip 2 forms an oblique downward component force to prevent the billiard ball 3 from bouncing upward, thereby avoiding the phenomenon of ball bounce when the billiard ball 3 strikes the rubber strip 2.

The ratio of the height difference H to the diameter D of the billiard ball 3 and the angle $\alpha$ are applicable to various models and series of pool tables. After the diameter D of the billiard ball 3 used in conjunction with the pool table is determined, a height range of the rail can be determined while ensuring no ball bounce. Otherwise, in a case where the height of the rail is determined, a billiard ball 3 enabling to prevent the occurrence of the ball bounce can be selected according to the height of the rail, thereby ensuring an excellent gaming experience and entertainment of billiards games through the ratio of the height difference H to the diameter D of the billiard ball 3, and providing a solid foundation for the further popularization and promotion of the billiards.

As shown in FIG. 2, in order to facilitate the mounting of the rubber strip 2 to the steel rail 4, a surface of a side of the steel rail 4 facing toward the rubber strip 2 is provided with a first groove extending along a length direction of the steel rail 4, and the first groove is an embedding groove. The rubber strip is provided with a protrusion 12 fitting the first groove in shape. The protrusion 12 is embedded in the first groove. The first groove can be a dovetail groove, a rectangular groove, a T-shaped groove or a trapezoidal groove. Accordingly, the protrusion 12 can be a dovetail-shaped protrusion, a rectangular protrusion, a T-shaped protrusion or a trapezoidal protrusion.

Due to the arrangement of the first groove provided at the surface of the side of the steel rail 4 where the rubber strip 2 is mounted and the protrusion 12 fitting the first groove in shape, the rubber strip 2 is fitted with the steel rail 4 in a concave-convex manner, such that a rapid positioning and mounting of the rubber strip 2 and the steel rail 4 can be realized, thereby shortening the assembly time and improving the assembly efficiency of the rail structure. Meanwhile, the concave-convex fitting between the first groove and the protrusion 12 also facilitates the restriction of the rubber strip 2 in a vertical direction, which can prevent the rubber strip 2 from being dislocated due to weak mounting, and reduce the downward deformation of the rubber strip 2, further reducing the probability of ball bounce.

When the rubber strip 2 is fixedly mounted on the steel rail 4, the rubber strip 2 can be connected to the steel rail 4 through an adhesive. A cross section of the rubber strip 2 can be in a rectangular shape or a "]" shape.

As shown in FIG. 2, when the rail is assembled around the playing field, a bolt 7 and a nut 8 can be used to fix the rail on the side of the slate 1. The steel rail 4 is provided with a through hole configured for threading the bolt 7. One end of the bolt 7 passes through the steel rail 4 and the slate 1 to be threadedly connected to the nut 8 embedded in the slate 1. The steel rail 4 includes a surface abutting a side of the slate 1. The surface of the steel rail 4 abutting the side of the playing field is provided with a second groove 6. The second groove 6 can be a rectangular groove.

Embodiment 3

A pool table capable of avoiding ball bounce is provided, including a playing field and a rail structure mounted along an edge of the playing field. FIG. 1 is a cross-sectional view of an assembly of the playing field and the rail structure. The playing field is arranged horizontally and supported by multiple legs (not shown in the drawings).

The playing field can be composed of a spliced slate 1 and a tablecloth 5 wrapping the slate 1.

The rail structure includes a steel rail 4 and a rubber strip 2 mounted at an inner side of the steel rail 4. As shown in FIG. 1, the steel rail 4 is mounted on an outer peripheral side of the slate 1, and is configured for stopping a billiard ball 3. The rubber strip 2 is mounted at a top inner side of the steel rail 4. A handrail 10 is mounted at an outer side of the steel rail 4. In order to make the pool table in an elegant appearance, the rubber strip 2 and an outer side of the playing field are wrapped with the table cloth 5. The billiard ball 3 will strike the rubber strip 2 when it moves to the rail, leading to a rebound force. In order to prevent the billiard ball 3 from falling when it reaches the rail, there is a height difference H between a top surface of the rubber strip 2 and a top surface of the playing field. A ratio of the height difference H to a diameter D of the billiard ball 3 is 0.68-0.74, such as 0.68, 0.69, 0.70, 0.71, 0.72, 0.73 and 0.74.

When the billiard ball 3 rolls along the playing field after being hit by a player, the billiard ball 3 is in contact with the rubber strip 2 to form a striking point J. A center of the billiard ball 3 is configured as an origin O of a coordinate system. A horizontal line passing through the origin O is configured as an abscissa axis X of the coordinate system, and a vertical line passing through the origin O is configured as an ordinate axis Y. The striking point J is higher than the center of billiard ball 3. An angle $\alpha$ of 2 degrees to 8 degrees is formed between a line OJ connecting the origin O to the striking point J and the abscissa axis X, and can be 2 degrees, 3 degrees, 4 degrees, 5 degrees, 6 degrees, 7 degrees or 8 degrees.

For the above pool table, a ratio of a height of the rail to the diameter D of the billiard ball is optimized to prevent ball bounce. The height difference H is set to be 0.68-0.74 times the diameter D of the billiard ball 3. When the height difference H is less than 0.68 times the diameter D of the billiard ball 3, the ball bounce will occur. When the height difference H greater than 0.74 times the diameter D of the billiard ball 3, an elasticity of the rail will decrease significantly, thus affecting the rebound effect of the billiard ball 3 after striking the rubber strip 2, making the player unable to accurately control a force applied to the billiard ball 3 and a movement trajectory of the billiard ball 3 after striking, thereby affecting the performance of the player and the entertainment of billiards games.

In order to further improve the capacity of avoiding ball bounce of the pool table, while optimizing a height of the rubber strip 2, a position of the striking point J is innovatively designed, that is, based on the existing billiard ball 3, when the billiard ball 3 comes into contact with the rubber strip 2, the angle between the line OJ and the abscissa axis X is set to be 2 degrees to 8 degrees. Based on the precise design of a range of the angle $\alpha$, a striking force generated by the billiard ball 3 when it strikes the rubber strip 2 forms an oblique downward component force to prevent the billiard ball 3 from bouncing upward, thereby avoiding the phenomenon of ball bounce when the billiard ball 3 strikes the rubber strip 2.

The ratio of the height difference H to the diameter D of the billiard ball 3 and the angle $\alpha$ are applicable to various models and series of pool tables. After the diameter D of the billiard ball 3 used in conjunction with the pool table is determined, a height range of the rail can be determined while ensuring no ball bounce. Otherwise, in a case where the height of the rail is determined, a billiard ball 3 enabling to prevent the occurrence of the ball bounce can be selected according to the height of the rail, thereby ensuring an excellent gaming experience and entertainment of billiards games through the ratio of the height difference H to the diameter D of the billiard ball 3, and providing a solid foundation for the further popularization and promotion of the billiards.

In an embodiment, a cross section of the steel rail 4 is in, but not limited to, a rectangular shape, a trapezoidal shape, an S shape, a "]" shape, an L shape, a T shape, an I shape, a "]" shape or a "[" shape. In this embodiment, the steel rail 4 is in the "]" shape, as shown in FIGS. 1-2. However, the cross section of the steel rail 4 is not limited to the "]" shape in FIG. 1, which can also be the rectangular shape in FIG. 3.

As shown in FIG. 2, in order to facilitate the mounting of the rubber strip 2 to the steel rail 4, a surface of a side of the steel rail 4 facing toward the rubber strip 2 is provided with a first groove extending along a length direction of the steel rail 4, and the first groove is an embedding groove. The rubber strip is provided with a protrusion 12 fitting the first groove in shape. The protrusion 12 is embedded in the first groove. The first groove can be a dovetail groove, a rectangular groove, a T-shaped groove or a trapezoidal groove. Accordingly, the protrusion 12 can be a dovetail-shaped protrusion, a rectangular protrusion, a T-shaped protrusion or a trapezoidal protrusion.

Due to the arrangement of the first groove provided at the surface of the side of the steel rail 4 where the rubber strip 2 is mounted and the protrusion 12 fitting the first groove in shape, the rubber strip 2 is fitted with the steel rail 4 in a concave-convex manner, such that a rapid positioning and mounting of the rubber strip 2 and the steel rail 4 can be realized, thereby shortening the assembly time and improving the assembly efficiency of the rail structure. Meanwhile, the concave-convex fitting between the first groove and the protrusion 12 also facilitates the restriction of the rubber strip 2 in a vertical direction, which can prevent the rubber strip 2 from being dislocated due to weak mounting, and reduce the downward deformation of the rubber strip 2, further reducing the probability of ball bounce.

When the rubber strip 2 is fixedly mounted on the steel rail 4, the rubber strip 2 can be connected to the steel rail 4 through an adhesive. A cross section of the rubber strip 2 can be in a rectangular shape or a "]" shape.

As shown in FIG. 1, when the rail is assembled around the playing field, a bolt 7 and a nut 8 can be used to fix the rail on the side of the slate 1. The steel rail 4 is provided with a through hole configured for threading the bolt 7. One end of the bolt 7 passes through the steel rail 4 and the slate 1 to be threadedly connected to the nut 8 embedded in the slate 1. The steel rail 4 includes a surface abutting a side of the slate 1. The surface of the steel rail 4 abutting the side of the playing field is provided with a second groove 6. The second groove 6 can be a rectangular groove.

In order to ensure the mounting accuracy of the pool table, a joint surface of the steel rail 4 in contact with the slate 1 requires a high surface accuracy. Before assembly, the joint surface of the steel rail 4 needs to be processed with high accuracy. Since the second groove 6 is provided on the surface of the side of the steel rail 4 abutting the slate 1, a processing surface area of the steel rail 4 can be greatly reduced through the addition of the second groove 6. Moreover, an inner side of the second groove 6 does not require high machining accuracy. Therefore, the arrangement of the second groove 6 on the surface of the steel rail 4 can reduce the processing area of the steel rail 4, which can improve the processing efficiency of the steel rail 4 and the surface flatness of the steel rail 4, thereby improving the assembly accuracy and assembly quality of the pool table.

In order to improve the aesthetics of the pool table, the slate 1 is decoratively wrapped with a piece of the table cloth 5, and the rail structure is decoratively wrapped with another piece of the table cloth 5. The steel rail 4 and the rubber strip 2 can be sheltered by the table cloth 5 wrapped around the rail structure. When using the table cloth 5 to wrap the rubber strip 2 and the steel rail 4, a top end of the table cloth 5 is fixedly mounted at the steel rail 4, and a bottom end of the table cloth 5 is fixedly mounted between the slate 1 and the steel rail 4. As shown in FIG. 1, an inner side of the rail structure is wrapped with the table cloth 5. The table cloth 5 is wrapped around the rubber strip 2. One side of the steel rail 4 away from the rubber strip 2 is provided with an opening. The top end of the table cloth 5 is pressed against the steel rail 4 through a pressing strip 11 pressed in the opening. Meanwhile, the pressing strip 11 is pressed through the handrail 10, such that the top end of the table cloth 5 is further pressed. A bottom end of the steel rail 4 is fixedly connected to the slate 1 through the bolt 7 and the nut 8. The nut 8 is embedded in the opening of the slate 1. The bolt 7 passes through the through hole at the bottom end of the steel rail 4 and a perforation of the slate 1 to be threadedly connected to the nut 8. While the slate 1 is fixedly connected to the steel rail 4, the bottom end of the table cloth 5 is pressed between the slate 1 and the steel rail 4.

Embodiment 4

A pool table capable of avoiding ball bounce is provided, including a playing field and a rail structure mounted along an edge of the playing field. FIG. 1 is a cross-sectional view of an assembly of the playing field and the rail structure. The playing field is arranged horizontally and supported by multiple legs (not shown in the drawings).

The playing field can be composed of a spliced slate 1 and a tablecloth 5 wrapping the slate 1.

The rail structure includes a steel rail 4 and a rubber strip 2 mounted at an inner side of the steel rail 4. As shown in FIG. 1, the steel rail 4 is mounted on an outer peripheral side of the slate 1, and is configured for stopping a billiard ball 3. The rubber strip 2 is mounted at a top inner side of the steel rail 4. A handrail 10 is mounted at an outer side of the steel rail 4. In order to make the pool table in an elegant appearance, the rubber strip 2 and an outer side of the playing field are wrapped with the table cloth 5. The billiard ball 3 will strike the rubber strip 2 when it moves to the rail, leading to a rebound force. In order to prevent the billiard ball 3 from falling when it reaches the rail, there is a height difference H between a top surface of the rubber strip 2 and a top surface of the playing field. A ratio of the height difference H to a diameter D of the billiard ball 3 is 0.68-0.74, such as 0.68, 0.69, 0.70, 0.71, 0.72, 0.73 and 0.74.

When the billiard ball 3 rolls along the playing field after being hit by a player, the billiard ball 3 is in contact with the rubber strip 2 to form a striking point J. A center of the billiard ball 3 is configured as an origin O of a coordinate system. A horizontal line passing through the origin O is configured as an abscissa axis X of the coordinate system, and a vertical line passing through the origin O is configured as an ordinate axis Y. The striking point J is higher than the center of billiard ball 3. An angle $\alpha$ of 2 degrees to 8 degrees is formed between a line OJ connecting the origin O to the striking point J and the abscissa axis X, and can be 2 degrees, 3 degrees. 4 degrees. 5 degrees, 6 degrees, 7 degrees or 8 degrees.

For the above pool table, a ratio of a height of the rail to the diameter D of the billiard ball is optimized to prevent ball bounce. The height difference H is set to be 0.68-0.74 times the diameter D of the billiard ball 3. When the height difference H is less than 0.68 times the diameter D of the billiard ball 3, the ball bounce will occur. When the height difference H is greater than 0.74 times the diameter D of the billiard ball 3, an elasticity of the rail will decrease significantly, thus affecting the rebound effect of the billiard ball 3 after striking the rubber strip 2, making the player unable to accurately control a force applied to the billiard ball 3 and a movement trajectory of the billiard ball 3 after striking, thereby affecting the performance of the player and the entertainment of billiards games.

In order to further improve the capacity of avoiding ball bounce of the pool table, while optimizing a height of the rubber strip 2, a position of the striking point J is innovatively designed, that is, based on the existing billiard ball 3, when the billiard ball 3 comes into contact with the rubber strip 2, the angle between the line OJ and the abscissa axis X is set to be 2 degrees to 8 degrees. Based on the precise design of a range of the angle $\alpha$, a striking force generated by the billiard ball 3 when it strikes the rubber strip 2 forms an oblique downward component force to prevent the billiard ball 3 from bouncing upward, thereby avoiding the phenomenon of ball bounce when the billiard ball 3 strikes the rubber strip 2.

The ratio of the height difference H to the diameter D of the billiard ball 3 and the angle $\alpha$ are applicable to various models and series of pool tables. After the diameter D of the billiard ball 3 used in conjunction with the pool table is determined, a height range of the rail can be determined while ensuring no ball bounce. Otherwise, in a case where the height of the rail is determined, a billiard ball 3 enabling to prevent the occurrence of the ball bounce can be selected according to the height of the rail, thereby ensuring an excellent gaming experience and entertainment of billiards games through the ratio of the height difference H to the diameter D of the billiard ball 3, and providing a solid foundation for the further popularization and promotion of the billiards.

In an embodiment, a cross section of the steel rail 4 is in, but not limited to, a rectangular shape, a trapezoidal shape, an S shape, a "]" shape, an L shape, a T shape, an I shape, a "]" shape or a "[" shape. In this embodiment, the steel rail 4 is in the "]" shape, as shown in FIGS. 1-2. However, the cross section of the steel rail 4 is not limited to the "]" shape in FIG. 1, which can also be the rectangular shape in FIG. 3.

As shown in FIG. 2, in order to facilitate the mounting of the rubber strip 2 to the steel rail 4, a surface of a side of the steel rail 4 facing toward the rubber strip 2 is provided with a first groove extending along a length direction of the steel rail 4, and the first groove is an embedding groove. The rubber strip is provided with a protrusion 12 fitting the first groove in shape. The protrusion 12 is embedded in the first groove. The first groove can be a dovetail groove, a rectangular groove, a T-shaped groove or a trapezoidal groove. Accordingly, the protrusion 12 can be a dovetail-shaped protrusion, a rectangular protrusion, a T-shaped protrusion or a trapezoidal protrusion.

Due to the arrangement of the first groove provided at the surface of the side of the steel rail 4 where the rubber strip 2 is mounted and the protrusion 12 fitting the first groove in shape, the rubber strip 2 is fitted with the steel rail 4 in a concave-convex manner, such that a rapid positioning and mounting of the rubber strip 2 and the steel rail 4 can be realized, thereby shortening the assembly time and improving the assembly efficiency of the rail structure. Meanwhile, the concave-convex fitting between the first groove and the protrusion 12 also facilitates the restriction of the rubber strip 2 in a vertical direction, which can prevent the rubber strip 2 from being dislocated due to weak mounting, and reduce the downward deformation of the rubber strip 2, further reducing the probability of ball bounce.

When the rubber strip 2 is fixedly mounted on the steel rail 4, the rubber strip 2 can be connected to the steel rail 4 through an adhesive. A cross section of the rubber strip 2 can be in a rectangular shape or a "]" shape.

As shown in FIG. 1, when the rail is assembled around the playing field, a bolt 7 and a nut 8 can be used to fix the rail on the side of the slate 1. The steel rail 4 is provided with a through hole configured for threading the bolt 7. One end of the bolt 7 passes through the steel rail 4 and the slate 1 to be threadedly connected to the nut 8 embedded in the slate 1. The steel rail 4 includes a surface abutting a side of the slate 1. The surface of the steel rail 4 abutting the side of the playing field is provided with a second groove 6. The second groove 6 can be a rectangular groove.

In order to ensure the mounting accuracy of the pool table, a joint surface of the steel rail 4 in contact with the slate 1 requires a high surface accuracy. Before assembly, the joint surface of the steel rail 4 needs to be processed with high accuracy. Since the second groove 6 is provided on the surface of the side of the steel rail 4 abutting the slate 1, a processing surface area of the steel rail 4 can be greatly reduced through the addition of the second groove 6. Moreover, an inner side of the second groove 6 does not require high machining accuracy. Therefore, the arrangement of the second groove 6 on the surface of the steel rail 4 can reduce the processing area of the steel rail 4, which can improve the processing efficiency of the steel rail 4 and the surface flatness of the steel rail 4, thereby improving the assembly accuracy and assembly quality of the pool table.

In order to improve the aesthetics of the pool table, the slate 1 is decoratively wrapped with a piece of the table cloth 5, and the rail structure is decoratively wrapped with another piece of the table cloth 5. The steel rail 4 and the rubber strip 2 can be sheltered by the table cloth 5 wrapped around the rail structure. When using the table cloth 5 to wrap the rubber strip 2 and the steel rail 4, a top end of the table cloth 5 is fixedly mounted at the steel rail 4, and a bottom end of the table cloth 5 is fixedly mounted between the slate 1 and the steel rail 4. As shown in FIG. 1, an inner side of the rail structure is wrapped with the table cloth 5. The table cloth 5 is wrapped around the rubber strip 2. One side of the steel rail 4 away from the rubber strip 2 is provided with an opening. The top end of the table cloth 5 is pressed against the steel rail 4 through a pressing strip 11 pressed in the opening. Meanwhile, the pressing strip 11 is pressed through the handrail 10, such that the top end of the table cloth 5 is further pressed. A bottom end of the steel rail 4 is fixedly connected to the slate 1 through the bolt 7 and the nut 8. The nut 8 is embedded in the opening of the slate 1. The bolt 7 passes through the through hole at the bottom end of the steel rail 4 and a perforation of the slate 1 to be threadedly connected to the nut 8. While the slate 1 is fixedly connected to the steel rail 4, the bottom end of the table cloth 5 is pressed between the slate 1 and the steel rail 4.

When the cross section of the steel rail 4 is in the "]" shape as shown in FIGS. 1-2, the steel rail 4 includes a horizontal extension portion 41 and a vertical extension portion 42. A width T1 of the horizontal extension portion 41 is equal to a width T2 of the vertical extension portion 42, and the width T1 and the width T2 are both 20 mm (0.787 inches). Compared with the prior art, when the width T1 and the width T2 are equal and both 20 mm (0.787 inches), without affecting the ability of the steel rail 4 to withstand a horizontal striking force of the billiard ball 3, each pool table can save 1% of the table cloth used for the playing field, 4% of the table cloth used for the rail structure, 15% of steel used for the steel rail and 1% of slate, which greatly facilitates the green environmental protection.

In summary, the embodiments described above are merely illustrative of the present application, and are not intended to limit the scope of the present application. Various modifications, replacements and improvements made by those of ordinary skill in the art without departing from the spirit of this application shall fall within the scope of the disclosure defined by the appended claims.

What is claimed is:

1. A pool table capable of avoiding ball bounce, comprising:

a playing field; and a rail structure mounted along an edge of the playing field;

wherein the rail structure comprises a steel rail and a rubber strip mounted at an inner side of the steel rail; and a ratio of a height difference H between a top surface of the rubber strip and a top surface of the playing field to a diameter D of a billiard ball is 0.68-0.74; and a position of the rubber strip configured to be in contact with the billiard ball is configured as a striking point; a center of the billiard ball is configured as an origin of a coordinate system; a horizontal line passing through the origin is configured as an abscissa axis of the coordinate system, and a vertical line passing through the origin is configured as an ordinate axis; the striking point is higher than the center of the billiard ball; and an angle between a line connecting the origin to the striking point and the abscissa axis is 2 degrees to 8 degrees; and wherein the steel rail is arranged between a handrail and the playing field;

a surface of a side of the steel rail facing toward the rubber strip is provided with a first groove extending along a length direction of the steel rail;

the rubber strip is provided with a protrusion fitting the first groove in shape; and the protrusion is embedded in the first groove.

2. The pool table of claim 1, wherein a cross section of the steel rail is in a shape selected from the group consisting of a rectangular shape, a trapezoidal shape, an S shape, a "]" shape, an L shape, a T shape, an I shape, a "]" shape and a "[" shape.

3. The pool table of claim 1, wherein the ratio of the height difference H to the diameter D of the billiard ball is 0.7; and the angle between the line connecting the origin to the striking point and the abscissa axis is 5 degrees.

4. The pool table of claim 1, wherein the first groove is a groove selected from the group consisting of a dovetail groove, a rectangular groove, a T-shaped groove and a trapezoidal groove.

5. The pool table of claim 1, wherein a cross section of the rubber strip is in a shape selected from the group consisting of a rectangular shape, a trapezoidal shape and a "]" shape.

6. The pool table of claim 4, wherein a cross section of the rubber strip is in a shape selected form the group consisting of a rectangular shape, a trapezoidal shape and a "]" shape.

7. The pool table of claim 1, wherein a surface of the steel rail abutting a side of the playing field is provided with a groove.

8. The pool table of claim 7, wherein the groove is a rectangular groove.

9. The pool table of claim 1, wherein a surface of the steel rail abutting a side of the playing field is provided with a second groove.

10. The pool table of claim 9, wherein the second groove is a rectangular groove.

11. The pool table of claim 4, wherein a surface of the steel rail abutting a side of the playing field is provided with a second groove.

12. The pool table of claim 11, wherein the second groove is a rectangular groove.

13. The pool table of claim 5, wherein a surface of the steel rail abutting a side of the playing field is provided with a groove.

14. The pool table of claim 13, wherein the groove is a rectangular groove.

15. The pool table of claim 1, wherein the steel rail comprises a horizontal extension portion and a vertical extension portion; and a width of the horizontal extension portion is equal to that of the vertical extension portion.

16. The pool table of claim 4, wherein the steel rail comprises a horizontal extension portion and a vertical extension portion; and a width of the horizontal extension portion is equal to that of the vertical extension portion.

17. The pool table of claim 5, wherein the steel rail comprises a horizontal extension portion and a vertical extension portion; and a width of the horizontal extension portion is equal to that of the vertical extension portion.

18. The pool table of claim 7, wherein the steel rail comprises a horizontal extension portion and a vertical extension portion; and a width of the horizontal extension portion is equal to that of the vertical extension portion.

19. The pool table of claim 8, wherein the steel rail comprises a horizontal extension portion and a vertical extension portion; and a width of the horizontal extension portion is equal to that of the vertical extension portion.

* * * * *